US005265871A

United States Patent [19]

Hanley

[11] Patent Number: 5,265,871

[45] Date of Patent: Nov. 30, 1993

[54] BASEBALL GLOVE CONDITIONING TOOL AND METHOD

[76] Inventor: Walter E. Hanley, 55 Carpenter Rd., Walpole, Mass. 02081

[21] Appl. No.: 18,846

[22] Filed: Feb. 17, 1993

[51] Int. Cl.[5] ..... A63B 71/00

[52] U.S. Cl. ..... 273/25

[58] Field of Search ..... 273/25, 26 R, 26 C, 273/323; 2/19; 206/315.1, 313, 292

[56] References Cited

U.S. PATENT DOCUMENTS 3,169,019 2/1965 GenJack ..... 273/323

4,418,849 12/1983 Samta ..... 2/19

4,637,610 1/1987 Carr ..... 273/26 C 4,930,773 6/1990 Outlaw ..... 273/25

*Primary Examiner*—Theatrice Brown

*Attorney, Agent, or Firm*—Walter E. Hanley, Jr.

[57] ABSTRACT

This invention pertains to a tool for conditioning baseball gloves for use, and to the method for using the tool. The tool comprises a handle, a head having a rounded striking surface consisting of at least a half-sphere, and means for coupling the head to the handle. The tool is used by grasping the handle and striking the pocket of the baseball glove with the striking surface of the head.

11 Claims, 2 Drawing Sheets

BASEBALL GLOVE CONDITIONING TOOL AND METHOD

BACKGROUND OF THE INVENTION

This invention relates to the field of baseball equipment, and particularly to methods and devices for placing baseball gloves in condition for use. As used herein, the term "baseball" encompasses softball, T-ball and all other variations of our national pastime in which a leather glove is used as an aid for catching the ball.

Anyone who has ever played baseball knows that a new glove, whether it be any of the various types of fielders' gloves or a catcher's mitt, is too inflexible to be put to immediate optimal use. Likewise, even a used glove which goes unused for a number of months, as is usually the case between playing seasons, will become stiff from lack of manipulation and loss of moisture in the leather. In either case, the glove must be properly "broken in," i.e., conditioned, before it will perform well.

In the well-known method for conditioning baseball gloves, one dons the glove on one hand and either repeatedly pounds the pocket of the glove with the fist of one's free hand, or repeatedly throws a baseball or softball into the pocket of the glove. A leather softening substance, such as neat's-foot oil or a lanolin-containing cream or soap, is sometimes first applied to the pocket to moisten and prevent abrasions to the leather and aid in shaping the pocket.

This known method for conditioning baseball gloves has obvious drawbacks. Pounding the pocket of the glove with one's fist is ultimately painful and potentially injurious, and that fact necessarily limits the force and number of impacts that can be applied in this manner. Repeatedly throwing a ball into the pocket of the glove is tedious and, if done indoors as it often is, risks injury to persons or damage to property from an errant throw or missed catch.

SUMMARY OF THE INVENTION

The tool which comprises this invention eliminates these drawbacks, among others. Its use enables a force of substantial impact to be applied to the pocket of a baseball glove—significantly greater than that which can be achieved by throwing a ball into the glove—while allowing one to keep one's throwing hand safely removed from the area of impact. Because of the greater force, fewer impacts are needed than when a ball is thrown into the glove. The risk of an errant throw or missed catch is also obviated.

The tool comprises an elongated handle, a head having a rounded striking surface and means for coupling the handle to the head. The coupling means may be either removably or permanently affixed to, or may be integrally part of, the handle, the head, or both. The rounded striking surface of the head is sized so as to produce approximately the same degree of contact with the pocket of a baseball glove that a baseball or softball would have. Thus, the striking surface of the head comprises at least a half-sphere, the diameter of which ranges between substantially that of a regulation baseball and substantially that of a regulation softball. The weight of the head also ranges between substantially that of a regulation baseball and substantially that of a regulation softball. The tool is used by grasping the handle and striking the pocket of the glove being conditioned with the striking surface of the head.

DESCRIPTION OF THE PREFERRED EMBODIMENT

Figure 2:
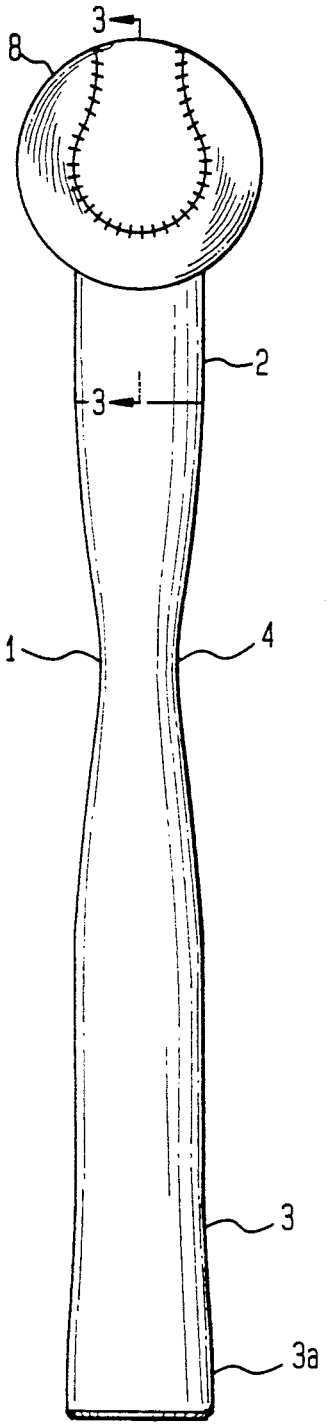
FIG. 2 is a front elevational view of the embodiment of FIG. 1.
Figure 3:
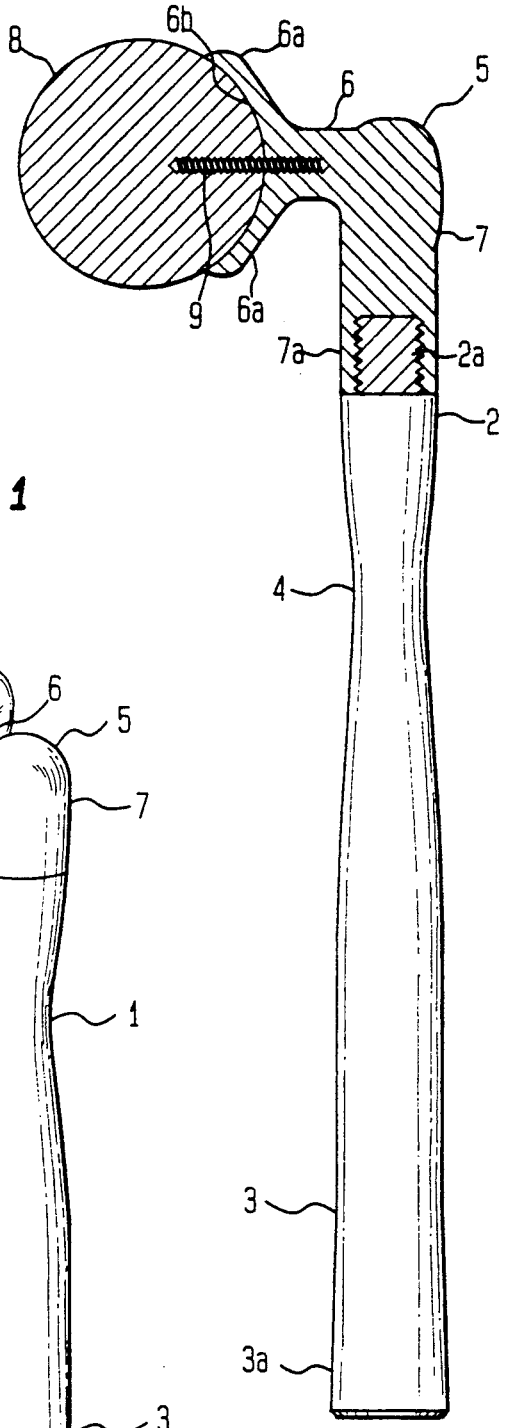
FIG. 3 is a left side elevational view of the embodiment of FIG. 1, shown in partial cross section taken along lines A—A of FIG. 2.
Figure 1:
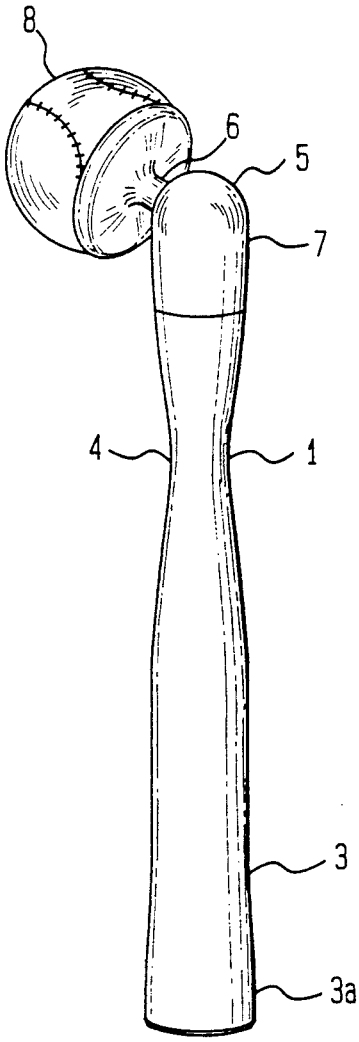
FIG. 1 is a left rear perspective view of an embodiment of the invention.

In one embodiment of the invention shown in FIGS. 1–3, the baseball glove conditioning tool includes an elongated handle 1 which is preferably oval in cross section, and may be formed of wood, plastic, aluminum or any other durable and relatively light weight material. The handle 1 has flared upper and lower sections 2,3 and a tapered midsection 4. Lower section 3 is sized to be gripped comfortably in the average size human hand, and has a more pronounced flared area at its extreme lower end 3*a* to help prevent the handle from slipping in the user's hand. Upper section 2 includes a threaded neck 2*a* having a circular cross section.

Mounted on the handle 1 is coupling means 5. Coupling means 5 is generally elbow-shaped and includes upper arm 6 and lower arm 7 extending substantially at a right angle to each other. Lower arm 7 is circular in cross section and includes a threaded sleeve portion 7*a* which removably engages threaded neck 2*a* of handle 1. Coupling means 5 is preferably made of a relatively rigid, tough light weight plastic material such as, for example, polyvinyl chloride.

Upper arm 6 of coupling means 5 is also circular in cross section and includes a flared portion 6*a* having a concave face 6*b* to which spheroid head 8 is joined. The curvature of face 6*b* matches the curvature of the adjoining surface of spheroid head 8 so as to centrally mount head 8 at the end of arm 6. Head 8 is removably fastened to arm 6 by a dowel screw 9 disposed along the axis of arm 6. Dowel screw 9 penetrates head 8 along a horizontal axis through head 8 to approximately the center of head 8 to insure that head 8 is firmly joined to arm 6. The length of arm 6 is selected such that the head 8 extends a sufficient lateral distance from handle 1 so as to minimize contact between the handle and the glove being conditioned when the tool is used, and yet not cause the tool to be unwieldy. Where, for example, the diameter of the head is approximately that of a baseball, the lateral distance between a vertical axis through the head and a vertical centerline through the handle is preferably in the range of 2–4 inches.

Also, the vertical distance between tapered midsection 4 of handle 1 and the axis of arm 6 is selected such that when the tool is used, contact between handle 1 and the baseball glove being conditioned is further minimized. For example, for a head having the diameter of a baseball, the distance between midsection 4 of the handle and the axis of arm 6 is preferably in the range of 3–6 inches.

Head 8 may consist of an actual baseball (as illustrated in FIGS. 1–3) or a softball in which a suitable size pilot hole has been drilled to snugly receive dowel screw 9. Head 8 may also be formed of plastic, aluminum, wood or other materials which are sufficiently resilient to withstand the repeated impacts to which the head will be subjected in use. Head 8 may be fastened to arm 6 of coupling means 5 using any suitable fastening means that will hold head 8 securely through repeated impacts. The striking surface of head 8 consists of at least the portion of the surface of the head forming a half-sphere on the side of the head opposite arm 6. The diameter of the striking surface and the weight of head 8 are preferably selected so as not to be substantially less than the diameter and weight of a regulation baseball, and not substantially more than the diameter and weight of a regulation softball.

Figure 5:
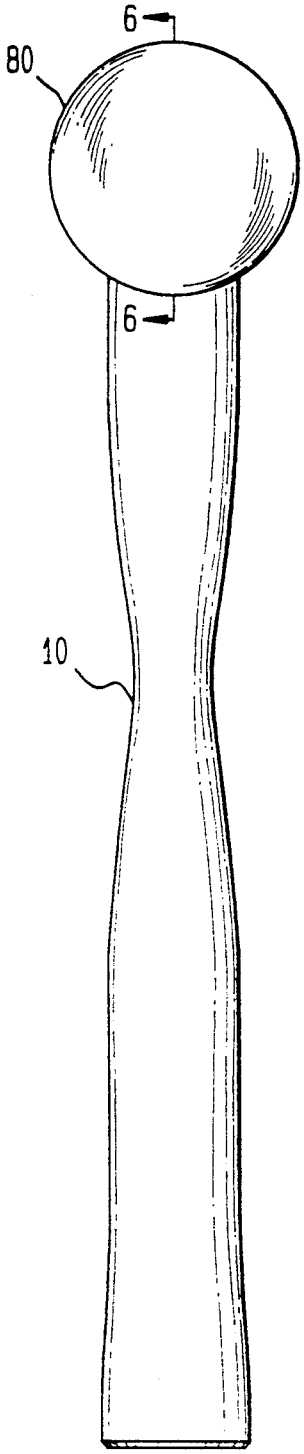
FIG. 5 is a front elevational view of the embodiment of FIG. 4.
Figure 6:
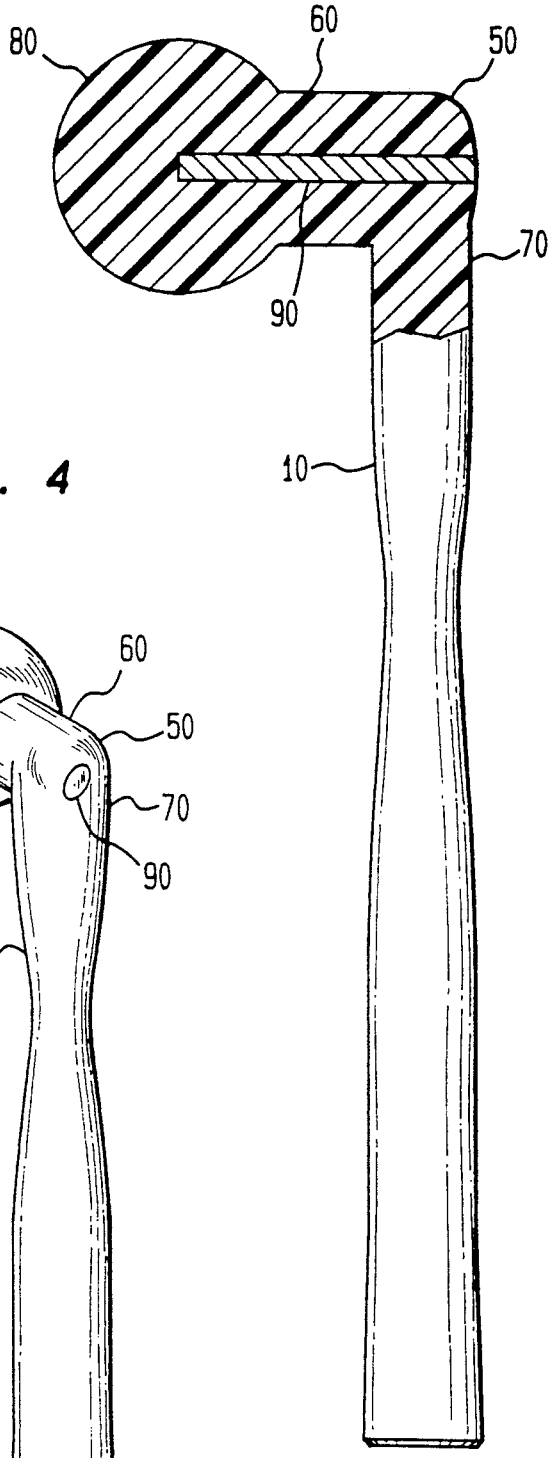
FIG. 6 is a left side elevational view of the embodiment of FIG. 4, shown in partial cross section taken along lines B—B of FIG. 5.
Figure 4:
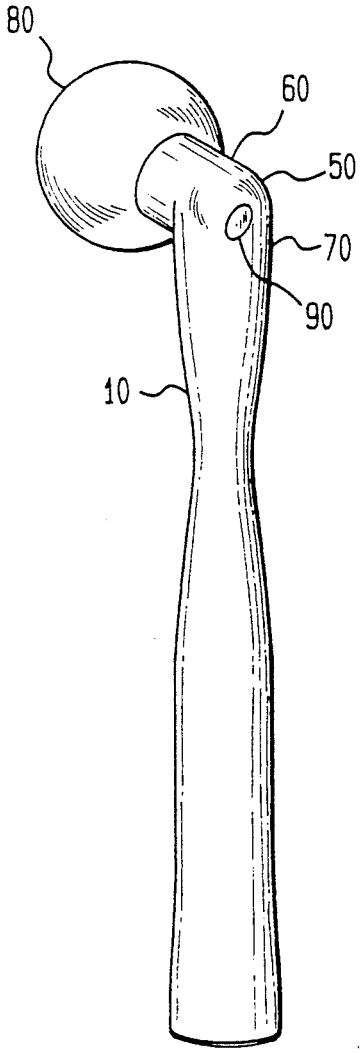
FIG. 4 is a left rear perspective view of an alternative embodiment of the invention.

In the alternative embodiment of the tool shown in FIGS. 4–6, handle 10, coupling means 50 and head 80 are integrally formed of any suitable rigid, tough, moldable plastic, such as polypropylene, polystyrene or polyvinyl chloride, by using conventional molding techniques. The shape and dimensions of the handle 10 are depicted as approximately the same as handle 1 in FIGS. 1–3. However, suitable modifications to the shape and dimensions of handle 10 so as to insure adequate structural strength and integrity, and yet also minimize the amount of plastic material used, will be apparent to those skilled in the art.

Head 80, like head 8 in the embodiment of FIGS. 1–3, has a striking surface consisting of at least the surface forming a half-sphere on the side of head 80 opposite coupling means 50. The diameter of the striking surface preferably ranges between approximately that of a regulation baseball and that of a regulation softball. Coupling means 50 is elbow-shaped and includes upper arm 60 and lower arm 70. As in the embodiment of FIGS. 1–3, the length of arm 60 of coupling means 50 is selected such that the lateral distance between head 80 and handle 10 is sufficient to minimize contact between the glove and the handle 10, but not so great as to make the tool unwieldy. As shown, upper arm 60 of coupling means 50 has a generally rectangular cross section and lower arm 70 of coupling means 50 has an oval cross section. However, arms 60 and 70 may have any suitable cross sectional shape so as to remain dimensionally stable, i.e., resist twisting and bending, when the hammer is used.

Depending upon the density of the plastic used to form the tool, it may be desirable to form a core 90 in head 80 through coupling means 50 in order to insure that the weight of head 80 is in the range between approximately that of a baseball and that of a softball. The size of the core 90 will depend upon the density of the plastic used to form the tool. The core 90 may be formed in the process of molding the tool or afterward, such as by drilling, or by any other suitable method.

The tool of this invention may be used after a leather softening substance is applied to the pocket of the glove to be conditioned, in the conventional manner. The user dons the glove, grasps the handle of the tool with his or her free hand and repeatedly strikes the pocket of the glove with the striking surface of the head of the tool.

I claim:

1. A tool for conditioning a baseball glove comprising:

an elongated handle;

a head for striking the pocket of a baseball glove, the head having a rounded striking surface comprising at least a half-sphere having a diameter ranging substantially between that of a regulation baseball and that of a regulation softball; and means for coupling the head to the handle, the coupling means being substantially elbow-shaped and having upper and lower arms, the upper arm extending away from the lower arm at substantially a right angle and having an end to which the head is joined.

2. A tool in accordance with claim 1 wherein the weight of the head ranges substantially between that of a regulation baseball and that of a regulation softball.

3. A tool in accordance with claim 2 wherein the lateral distance between a vertical axis through the head and a vertical centerline through the handle is substantially in the range of 2–4 inches.

4. A tool in accordance with claim 2 wherein the head is removably fastened to the upper arm of the coupling means.

5. A tool in accordance with claim 2 wherein the coupling means is removably mounted on the handle.

6. A tool in accordance with claim 1 wherein the handle, head and coupling means are integrally formed of a rigid, durable plastic.

7. A tool in accordance with claim 6 wherein a core extends into the head through the coupling means.

8. A tool in accordance with claim 7 wherein the weight of the head ranges substantially between that of a regulation baseball and that of a regulation softball.

9. A method of conditioning a baseball glove comprising the steps of:

donning the glove on one hand; grasping a tool with the free hand, the tool comprising:

a handle, a head having a rounded striking surface comprising at least a half-sphere having a diameter ranging substantially between that of a regulation baseball and that of a regulation softball, and means for coupling the head to the handle, the tool being grasped by the handle; and striking the pocket of the glove with the striking surface of the head of the tool.

10. A method in accordance with claim 9 wherein the weight of the head of the tool ranges substantially between that of a regulation baseball and that of a regulation softball.

11. A method in accordance with claim 9 wherein prior to grasping the tool, the method further comprises the step of applying a leather softening substance to the pocket of the glove.

* * * * *